US005927940A

United States Patent [19]

Lotz

[11] Patent Number: 5,927,940

[45] Date of Patent: Jul. 27, 1999

[54] DOUBLE-FLOW GAS FRICTION PUMP

[75] Inventor: Heinrich Lotz, Wetzlar, Germany

[73] Assignee: Pfeiffer Vacuum GmbH, Asslar, Germany

[21] Appl. No.: 08/908,630

[22] Filed: Aug. 7, 1997

[30] Foreign Application Priority Data

Aug. 23, 1996 [DE] Germany ..... 196 34 095

[51] Int. Cl.[6] ..... F01D 1/36

[52] U.S. Cl. ..... 415/90

[58] Field of Search ..... 415/90, 143, 185, 415/186, 198.1, 199.4, 199.5, 203, 223; 417/423.4

[56] References Cited

U.S. PATENT DOCUMENTS

| | | | |
|---|---|---|---|
| 3,759,626 | 9/1973 | Becker | 415/90 |
| 3,969,039 | 7/1976 | Shoulders | 415/90 |
| 4,830,584 | 5/1989 | Mohn | 415/143 |
| 5,772,395 | 6/1998 | Schofield | 415/90 |

FOREIGN PATENT DOCUMENTS

| | | | |
|---|---|---|---|
| 2302376 | 8/1973 | Germany | 415/90 |
| 536238 | 5/1941 | United Kingdom | 415/90 |

*Primary Examiner*—Christopher Verdier
*Attorney, Agent, or Firm*—Anderson, Kill & Olick, P.C.

[57] ABSTRACT

A double-flow gas friction pump including a shaft supported in the pump housing and extending at a right angle to an axis of the suction port, a rotor fixedly secured on the shaft for joint rotation therewith, a stator fixedly secured in the housing and cooperating with the rotor for pumping gas, and a discharge element located in the suction region of the pump and operatively connected with the shaft for joint rotation with the shaft and the rotor for conducting the gas from the suction port directly to the stator and the rotor.

6 Claims, 3 Drawing Sheets

DOUBLE-FLOW GAS FRICTION PUMP

BACKGROUND OF THE INVENTION

1. Field of the Invention

The present invention relates to a double-flow gas friction pump including a housing having suction and discharge ports, a shaft supported in the housing and extending at a right angle to an axis of the suction port, a rotor fixedly secured on the shaft for joint rotation therewith, and a stator fixedly secured in the housing and cooperating with the rotor for pumping gas.

2. Description of the Prior Art

In a conventional gas friction pump of a Gaede type a cylindrical rotor rotates in a cylindrical housing having an annular groove which is broken in one location. For increasing the pressure ratios, several stages are arranged one after another. In a modified embodiment of this gas friction pump, in the Holwerk gas friction pump, instead of several stages a spiral groove is provided. In another type of a gas friction pump, in the Siegbahn pump, the spiral grooves are provided on opposite sides of a disc-shaped rotor. All of the above-mentioned pumps are characterized by high pressure ratios. Therefore, these pumps in particular, the Siegbahn pump, are particularly suitable for applications in which a high fore-vacuum pressure exists. However, because of a narrow stator-rotor split, their suction capacity is limited. A higher suction capacity is provided by turbomolecular pumps, the turbine-shape construction of which provides for a larger discharge volume.

Molecular and turbomolecular pumps may have a single-flow or a double-flow construction. The advantage of a single-flow pumps consists in that the connection flange and, thus, the receiver of the discharge gas are directly attached on the high vacuum side of the pump rotor. Therefore, the pumped gas can be taken over directly by the pumping elements, without a substantial flow resistance, and conducted further.

The drawback of the double-flow pump consists in that the gas stream from the suction flange should be deviated in order to reach the pumping elements of the pump. This is associated with a high flow resistance and, thus, with large losses of suction capacities. However, the double-flow pumps have a basic advantage with respect to the single-flow pumps which consists in that conventional ball and magnetic bearings of different constructions permit to easily achieve the stability criteria required in the double-flow pumps. At that, the bearings and the drives are always located on a fore-vacuum side of the double-flow pumps, so that no impairment of the high vacuum with these elements takes place.

The suction region of a double-flow pump, in addition to bearing means and a drive, includes a double pumping surface for delivery of a gas. However, their advantage can only be partially used because, as it was discussed above, of a deviation of the gas stream, high flow losses take place.

Accordingly, an object of the present invention is to provide a double-flow gas friction pump in which the double pumping surface available in the suction region of the pump can be used more advantageously.

SUMMARY OF THE INVENTION

This and other objects of the present invention, which will become more apparent hereinafter, are achieved by providing a double-flow gas friction pump including a discharge element located in a suction region of the pump and operatively connected with the shaft for joint rotation with the shaft and the rotor for conducting the gas from the suction port directly to the stator and the rotor elements.

Providing an additional gas discharge element in the suction region substantially improves the power characteristics of a gas friction pump and, in particular, its suction capacity. This is because the discharge element according to the present invention permits to substantially decrease flow losses associated with the deviation of the gas flow in the suction region. The rotatable vanes, which form part of the discharge element, permit to directly conduct the gas stream from the suction port to the pumping elements. The flow losses can be further reduced when the cylindrical wheel forming the discharge element axially extends on opposite sides of the suction port axis so that it surrounds, at least partially, the stator and rotor elements. The discharge element according to the present invention can be used with different types of gas friction pumps. Below, the use of the discharge element according to the present invention in a turbomolecular pump and in Holwerk molecular pump will be described.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
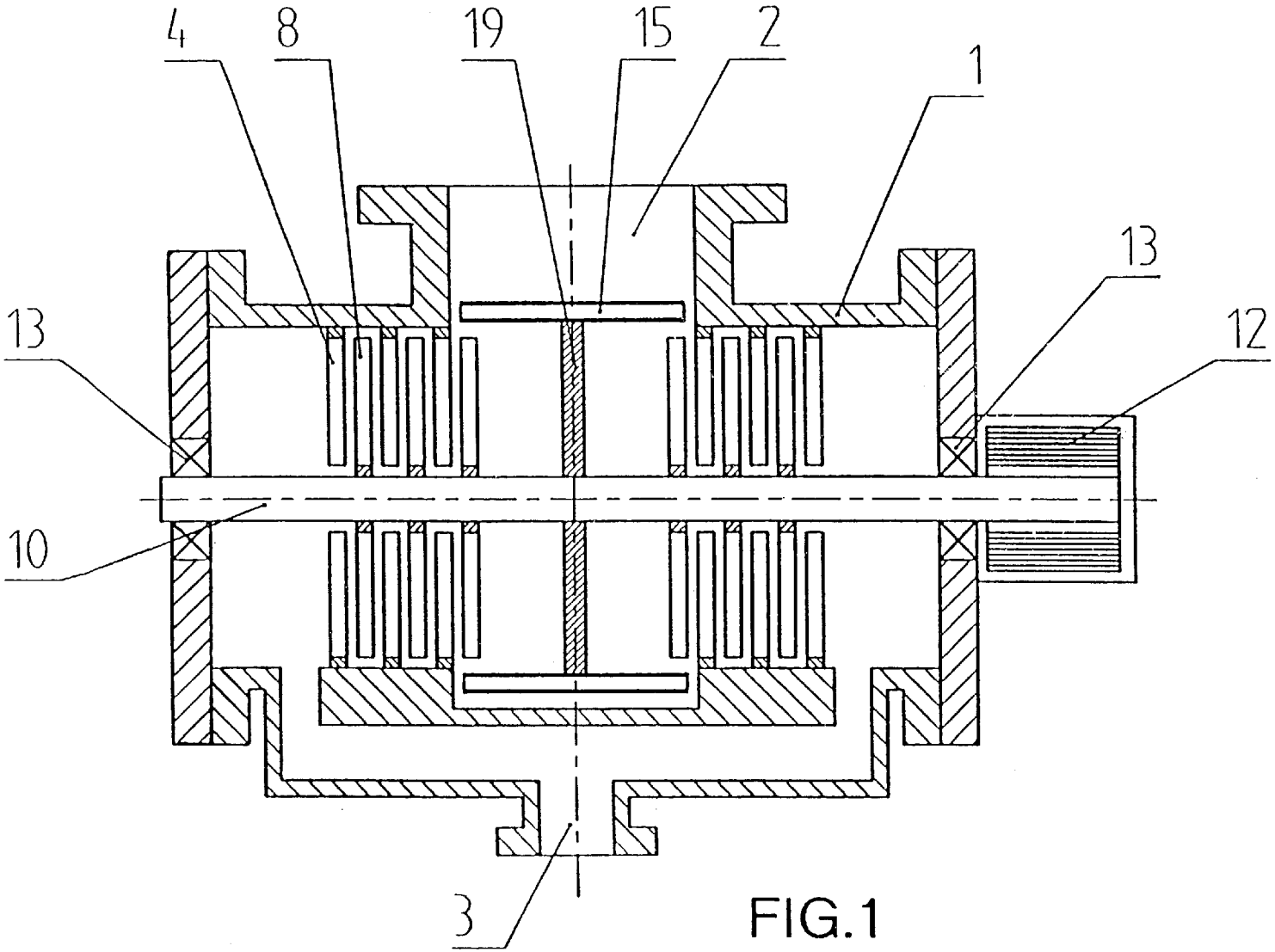
FIG. 1 shows a cross-sectional view of an input stage according to the present invention in combination with a turbomolecular pump.

FIG. 1 shows a gas friction pump formed as double-flow turbomolecular pump. The pump includes a housing 1 having a suction port 2 and a discharge port 3.

A shaft 10, located in the housing 1, is supported in two opposite bearing arrangements 13. The shaft 10 is driven by a drive 12. A plurality of rotatable wheels 8, which are equipped with vanes, is supported on the shaft 10. A plurality of stator discs 4, which are equipped with corresponding vanes, is alternatively arranged with respect to the rotatable wheels 8. The cooperation of the stator discs 4 with the wheels 8 create a necessary pumping action. As shown in the drawings, in the double-flow turbomolecular pumps, the rotor and stator elements are arranged transverse to the plane of the suction port 2. In order to insure a better flow of the gas stream from the suction port 2 to the stator and rotor elements, according to the present invention, a discharge element 15 is provided at the input or suction side of the pump. The discharge element 15 is rotatable together with the rotor wheels 8.

Figure 3:
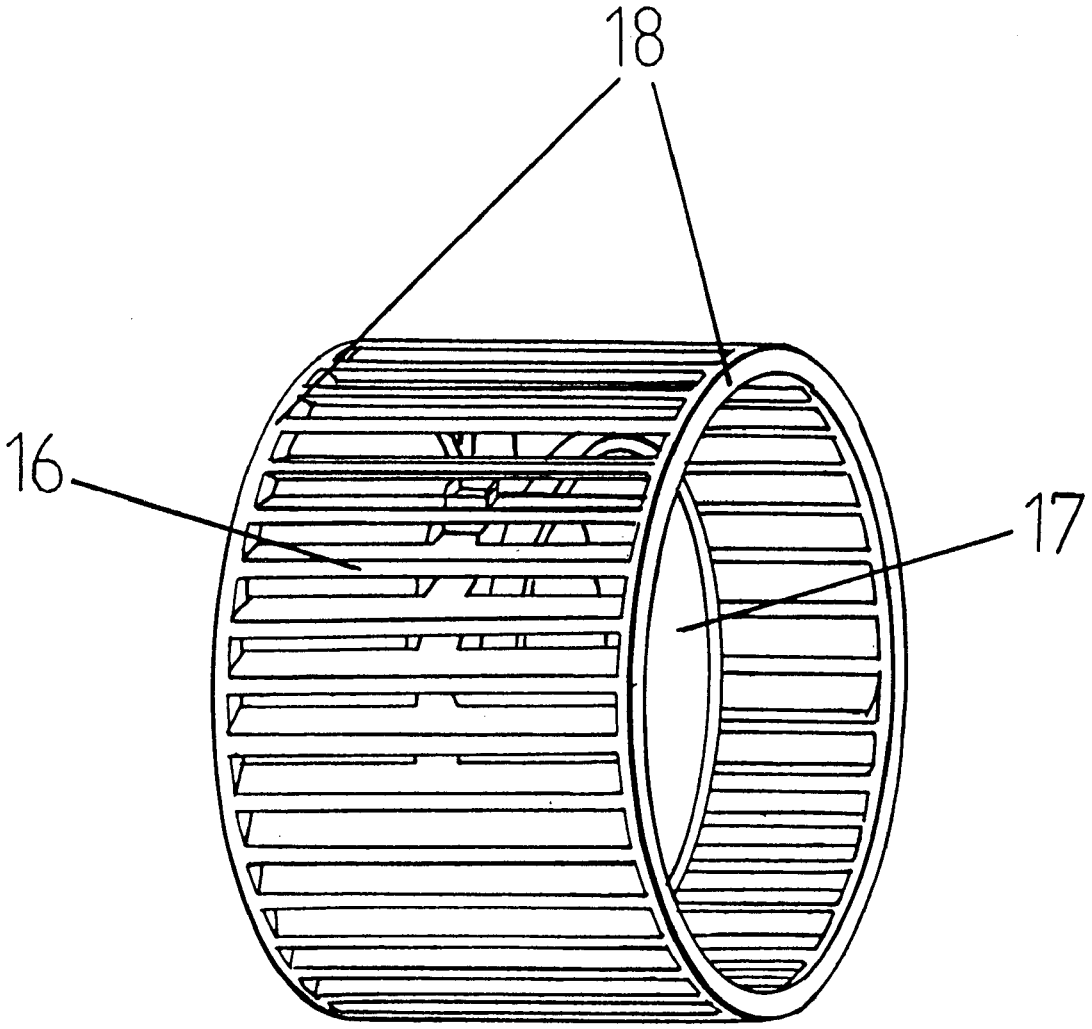
FIG. 3 shows a perspective view of a gas discharge element.

The construction of the discharge element 15 according to the present invention is shown in FIG. 3. The discharge element 15 is formed as a vane shell, the inner ring 17 of which or two outer rings 18 are equipped with vanes 16. For attaching the discharge element 15 to the rotor wheels 8, the inner ring is formed as a disc 19 fixedly secured on the shaft 10. Alternatively, the outer rings 18 can be fixedly connected with the inner rotor wheels 8.

Figure 2:
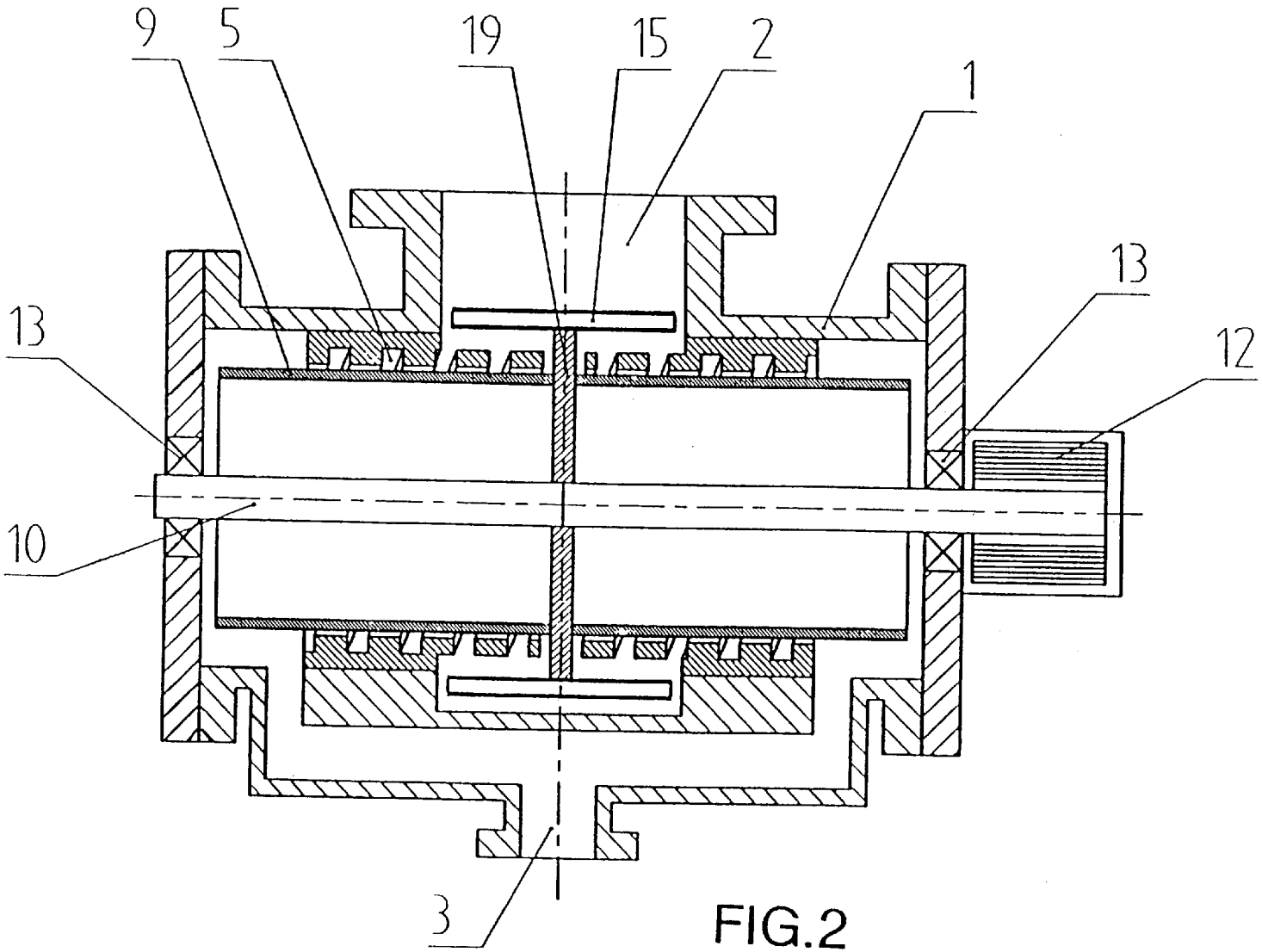
FIG. 2 shows a cross-sectional view of an input stage according to the present invention in combination with a conventional molecular pump.

FIG. 2 shows a conventional double-flow molecular pump. The stator element is provided with a spiral groove 5, and the rotor element is formed as a smooth cylinder 9. The discharge element 15 can be secured for the joint rotation with the rotor cylinder 9 in the same way as in FIG. 1, i.e. the inner disc 19 is fixedly secured on the shaft 10 or the outer rings 18 are fixedly connected with the rotor cylinder 9.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A double-flow gas friction pump, comprising:

a housing having suction and discharge ports;

a shaft supported in the housing and extending at a right angle to an axis of the suction port, rotor means fixedly secured on the shaft for joint rotation therewith;

stator means fixedly secured in the housing and cooperating with the rotor means for pumping gas; and a discharge element located in a suction region of the pump and operatively connected with the shaft for joint rotation with the shaft and the rotor means for conducting the gas from the suction port directly to the stator and rotor means, wherein the discharge element is formed as a cylindrical vane shell provided with a plurality of vanes forming a gas discharge structure.

2. A double-flow gas friction pump as set forth in claim 1, wherein the vane shell has an inner ring and two outer rings, and wherein the vanes are provided on one of the inner ring and the two outer rings.

3. A double-flow gas friction pump as set forth in claim 1, wherein the discharge element is coaxially arranged with the stator and rotor means.

4. A double-flow gas friction pump as set forth in claim 3, wherein the cylindrical vane shell extends axially on opposite sides of the suction port axis so that the vane shell surrounds, at least partially, the stator and rotor means.

5. A double-flow gas friction pump as set forth in claim 1, wherein the rotor means comprises a plurality of spaced wheels fixedly secured on the shaft, and the stator means comprises a plurality of discs alternatively arranged with respect to the rotor wheels and fixedly secured in the housing.

6. A double-flow gas friction pump as set forth in claim 1, wherein the stator means comprises a spiral groove, and the rotor means is formed as a smooth cylinder fixedly supported on the shaft, with a cylindrical surface of the cylinder facing the spiral groove.

* * * * *